US005634353A

United States Patent [19]

Hallin et al.

[11] Patent Number: 5,634,353

[45] Date of Patent: Jun. 3, 1997

[54] AIR DEHUMIDIFIER

[75] Inventors: Ingemar Hallin; Mattias Nyqvist, both of Stockholm, Sweden

[73] Assignee: Aktiebolaget Electrolux, Stockholm, Sweden

[21] Appl. No.: 603,983

[22] Filed: Feb. 20, 1996

[30] Foreign Application Priority Data

Mar. 2, 1995 [SE] Sweden ..... 9500765-4

[51] Int. Cl.[6] ..... F25B 15/00; F25D 17/06

[52] U.S. Cl. ..... 62/476; 62/73

[58] Field of Search ..... 62/93, 271, 272, 62/277, 291, 476, 485; 34/73

[56] References Cited

U.S. PATENT DOCUMENTS

| | | | |
|---|---|---|---|
| 2,059,877 | 11/1936 | Kogel . | |
| 2,179,734 | 11/1939 | Ullstrand | 62/476 |
| 2,682,758 | 7/1954 | Harris | 62/93 |
| 3,126,710 | 3/1964 | Boehmer et al. | 62/3.4 |
| 5,022,241 | 6/1991 | Wilkinson | 62/271 |
| 5,031,411 | 7/1991 | Gehring et al. . | |

FOREIGN PATENT DOCUMENTS

| | | | |
|---|---|---|---|
| 32953 | 3/1978 | Japan | 62/93 |
| 470270 | 12/1993 | Sweden . | |
| 1482236 | 8/1977 | United Kingdom . | |
| 2127955 | 4/1984 | United Kingdom . | |

*Primary Examiner*—William Doerrler

*Attorney, Agent, or Firm*—Pearne, Gordon, McCoy & Granger

[57] ABSTRACT

A dehumidifier (10) for air comprises an absorption refrigerating apparatus, the evaporator (14) of which being arranged in a first duct (22), through which the air by natural convection flows past the evaporator (14) and is refrigerated by it, so that the humidity in the air condenses on the evaporator (14). An absorber (16) and a condenser (20) of the apparatus are arranged in a second duct (26) and there heat extra air taken in from the room to the second duct (26) through an opening (34) and by natural convection flowing upwards through the second duct (26). An opening (32) is arranged between the ducts (22, 26), through which air which has been refrigerated and dehumidified in the first duct (22) flows into the second duct (26) and is there intermixed with the the flow of said extra air.

2 Claims, 1 Drawing Sheet

AIR DEHUMIDIFIER

The invention generally relates to a dehumidifier for dehumidifying air in a room, and more particularly relates to a dehumidifier which includes a cold surface arranged in a first duct, into which the air flows in through a first opening and then past the cold surface, which refrigerates the air so that the humidity in the air condenses on the cold surface, and an arrangement for subsequently heating the air, the cold surface being refrigerated by an evaporator of an absorption refrigerating apparatus.

Such an air dehumidifier is known through U.S. Pat. No. 2,179,734. This known dehumidifier is located outside the room and the air of which shall be dehumidified. The air is taken out through an opening in the wall of the room and via a tube is conducted to the cold surface. The cold surface constitutes the outside of an evaporator of an absorption refrigerating apparatus. The air flows past the cold surface in upwards direction, and is refrigerated and dehumidified. The air is then heated by a warm part of the evaporator, and is conducted back to the room through another tube. A fan is arranged in the room to circulate the air through the tubes and past the evaporator.

An absorption refrigerating apparatus has the quality of working silently.

SUMMARY OF THE INVENTION

The object of the invention is to improve the known dehumidifier so that the fan and the tubes can be eliminated so that the dehumidifier becomes silent and can be placed in the room, the air of which shall be dehumidified.

This object is reached by the dehumidifier according to the invention herein air by natural convection flows downwards through a first duct. An absorber and a condenser of the apparatus are arranged in a second duct to heat extra air. The extra air flows through a second opening located below the absorber and condenser from the room into the second duct and then by natural convection flows upwards through the second duct. A third opening is arranged between the ducts, through which air which has been refrigerated and dehumidified in the first duct flows into the second duct and is there intermixed with the flow of said extra air.

It shall be pointed out that through GB 2 127 955 is known a dehumidifier operated by a compression refrigerating apparatus. By the presence of a compressor such a refrigerating apparatus is difficult to make silent. In this known dehumidifier the air flows without the aid of a fan by natural convection past the evaporator and condenser of the apparatus. The known dehumidifier lacks, however, an opening for letting in extra air to the condenser. Such an opening in the dehumidifier according to the present invention makes the flows of air, past on one hand the evaporator and on the other hand the condenser and the absorber, practically independent of each other. Accordingly the evaporator, condenser, absorber and air ducts of the dehumidifier according to the present invention can be dimensioned, so that a good "dehumidification" (=the deposited amount of water per time unit) together with a good "dehumidification efficiency" (=the ratio between the deposited amount of water and the energy supplied) is obtained.

BRIEF DESCRIPTION OF THE DRAWINGS

An embodiment of a dehumidifier according to the invention is described below in connexion with the enclosed drawing, in which FIG. 1 in a perspective view shows the dehumidifier placed in the room, the air of which shall be dehumidified.

DETAILED DESCRIPTION OF PREFERRED EMBODIMENTS

Figure 2:
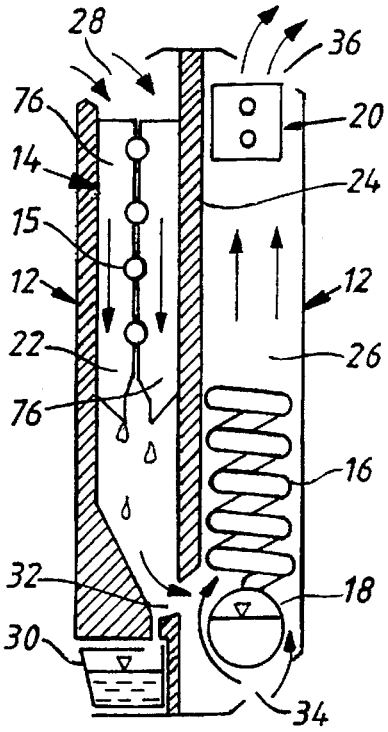
Figure 1:
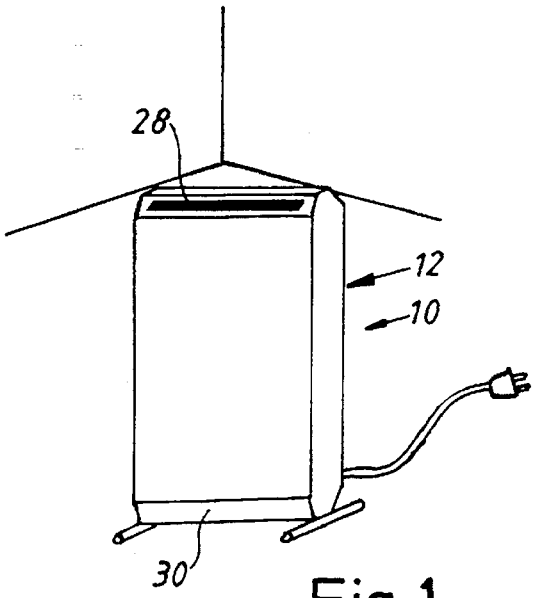

Referring to FIGS. 1 and 2, numeral 10 designates a dehumidifier, which inside a housing 12 includes an absorption refrigerating apparatus with an evaporator 14, an absorber 16, an absorber vessel 18 and a condenser 20. The evaporator 14, which is cold and heat absorbing, is arranged in a first vertical duct 22, which is formed between the housing 12 and a vertical wall 24. The absorber 16, the absorber vessel 18 and the condenser 20, which are warm and heat rejecting, are located on the other side of the wall 24 in a second duct 26, which outwardly is confined by the housing 12.

Air which shall be dehumidified flows from the room by natural convection into the duct 22 through an upper opening 28 in the housing 12 and is refrigerated by the evaporator 14, the humidity of the air condensing on the evaporator 14 and dripping down into a receptacle 30. The refrigerated and dehumidified air leaves the duct 22 through an opening 32, which leads into the second duct 26 between the absorber vessel 18 and the absorber 16, where the cold air from the duct 22 intermixes with and is heated by air flowing from the room into the second duct through a lower opening 34, located below the absorber vessel 18, in the housing 12 and by natural convection flowing upwards through the duct 26 and cooling the absorber vessel 18, the absorber 16 and the condenser 20. The dehumidified and heated air then flows back to the room through an upper opening 36 in the housing 12.

Figure 3:
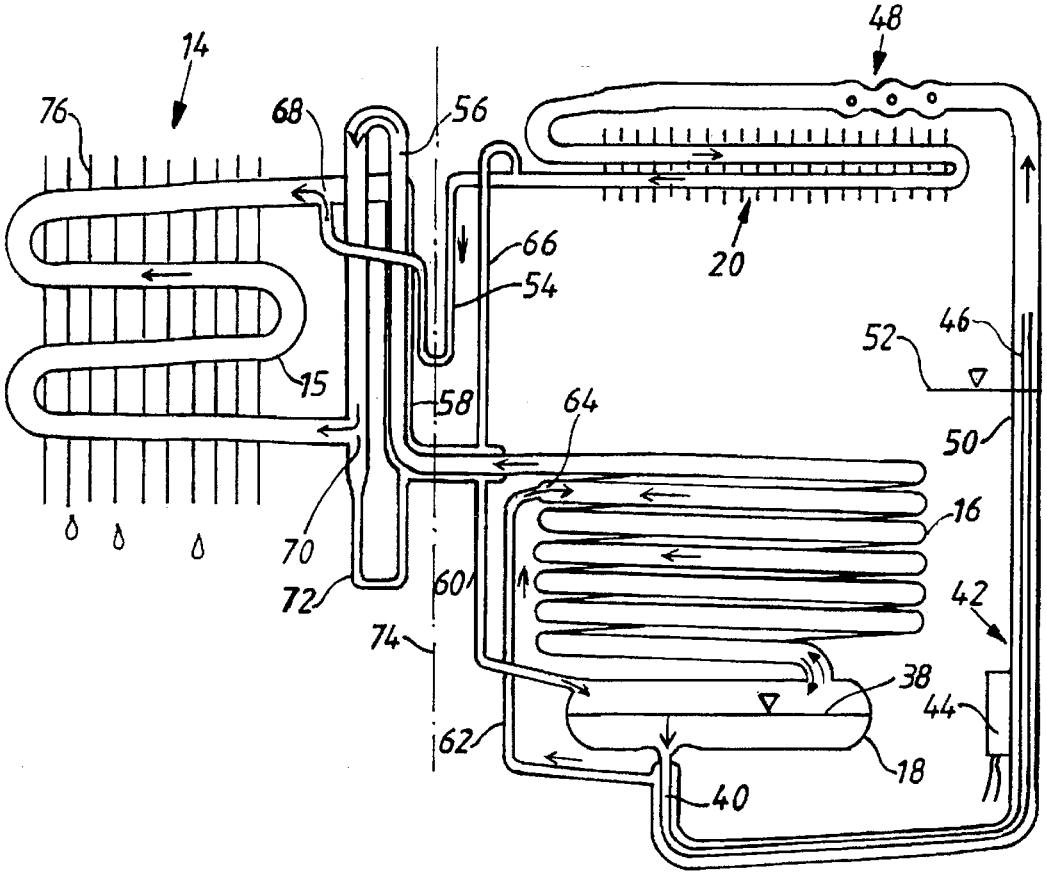
FIG. 2 shows a cross sectional view of the dehumidifier and FIG. 3 shows how an absorption refrigerating apparatus of the dehumidifier works.

The absorber vessel 18, see FIG. 3, contains up to a level 38 an absorption liquid, such as water, in which a refrigerant, such as ammonia, is dissolved. This solution, which is relatively rich in refrigerant, is called a rich solution. The rich solution exits from the absorber 18 through a conduit 40 and enters a boiler 42, in which the rich solution is supplied with heat from an electric heating cartridge 44. Refrigerant vapour boils off from the rich solution, which thereby becomes a so-called weak solution. The mixture of refrigerant vapour and weak solution is expelled through a pump pipe 46, the refrigerant vapour continuing to a separator 48, which separates out absorption liquid accompanying the refrigerant vapour, and the weak solutin being collected in an outer pipe 50 of the boiler 42 to a certain level 52.

The refrigerant vapour flows from the separator 48 to the condenser 20, where heat is transferred from the vapour to the surrounding air so that the vapour condenses. The refrigerant condensate leaves the condenser through a conduit 54 and enters the evaporator 14, which is constituted by a tube 15 having the shape of a lying M, where the condensate meets a flow of an inert gas, such as hydrogen, and is vaporized in the inert gas during absorption of heat. The inert gas is supplied to the evaporator 14 through a pipe 56 and the mixture of inert gas and vaporized refrigerant leaves the evaporator 14 through a pipe 58 and continues via a pipe 60 to the absorber vessel 18.

The mixture of refrigerant vapour and inert gas rises from the absorber vessel 18 through the absorber 16 and meets the weak solution, which, driven by the level 52, comes from the pipe 50 via a conduit 62 into the upper part of the absorber 16 at 64. When the weak solution flows downwards through the absorber 16, the weak solution absorbs refrigerant vapour flowing upwards during rejecting of heat to the surrounding air, the weak solution thereby becoming a rich solution again before it flows down and is collected in the absorber vessel 18 below the level 38. The rising inert gas continues from the absorber 16 to the pipe 56 and flows into the evaporator 14 and permits the refrigerant condensate to vaporize in it.

In order to prevent inert gas, which accompanies the refrigerant to the condenser, from collecting in the condenser and disturbing the outflow of refrigerant condensate from the condenser, a vent conduit 66 is arranged between the outlet of the condenser 20 and the conduit 58, from which conduit the inert gas is conducted to the absorber vessel 18 through the conduit 60.

In order that an effective dehumidification of the air shall take place, the evaporator should be constituted such, that its temperature falls in the direction of the flow of the air. This is the case with the dehumidifier according to said U.S. Pat. No. 2,179,734, see for example its page 2, lines 65–69. In the present invention, the temperature of the evaporator falls in the direction of the air flow, i.e. that parts of the evaporator located at a lower level become colder than parts located at a higher level, by the refrigerant condensate, which enters the evaporator 14 at its top at 68, running downwards in counterflow against the inert gas, which enters the evaporator 14 at its bottom at 70, and being vaporized in the inert gas. It shall be noted that such evaporators, where the condensate meets the inert gas in counterflow, are known per se as absorption refrigerating apparatuses through for example U.S. Pat. No. 2,059,877.

Under certain circumstances the refrigerant condensate can pass through the evaporator 14 without being vaporized and obstruct the inlet at 70 for inert gas. In order to prevent such an obstruction a drain pipe 72 is arranged for draining refrigerant condensate from 70 to the absorber vessel 18.

At the embodiment according to FIG. 2 the evaporator 14 shown in FIG. 3 is folded 180° substantially about a line 74 located at a vertical side edge of the wall 24, so that the evaporator will be located adjacent to the wall 24. Heat conductive flanges 76 are arranged on the tube 15 in order that the heat transfer between the air and the evaporator 14 shall be improved. The walls 12 and 24 enclosing the duct 22 are heat insulated in order that heat shall be prevented from leaking from the room and duct 26, respectively, through said walls to the evaporator 14.

The dehumidifier can also be built up around an absorption refrigerating apparatus, having the folded-out and flat shape shown in FIG. 3. In this case the evaporator 14 is enclosed by a first flat duct for the air to be dehumidified and the absorber 16 and the condenser 20 by a second flat duct for air which shall cool the condenser and the absorber. A third duct connects the flat ducts for conducting cold and dehumidified air from the first flat duct to the second flat duct. By its flat shape such a dehumidifier will be suitable for mounting on a wall.

The electric heating cartridge 44, in a dehumidifier according to the invention for dehumidifying a living-room, can have a power of 150 W. It is also possible to heat the boiler 42 by gas or by a liquid fuel.

We claim:

1. A dehumidifier (10) for dehumidifying air in a room, said dehumidifier (10) comprising: a cold surface (76) arranged in a first duct (22) such that air flows into the first duct though a first opening (28) and then past the cold surface (76) to refrigerate the air and condense out humidity on the cold surface (76), an absorption refrigerating apparatus including an evaporator (14) which refrigerates said cold surface (76), an absorber (16) and a condenser (20) the air flowing by natural convection downwards through the first duct (22), said absorber (16) and said condenser (20) arranged in a second duct (26) to heat extra air, the extra air flows into said second duct through a second opening (34) located below the absorber (16) and the condenser (20) from the room and then by natural convection flows upwards through said second duct, and a third opening (32) arranged between the ducts (22, 26), such that air refrigerated and dehumidified in the first duct (22) flows into the second duct (26) and is intermixed with the flow of said extra air.

2. The dehumidifier according to claim 1, wherein said cold surface (76) is arranged such that its temperature decreases in direction towards the third opening (32).

* * * * *